United States Patent [19]

Shibahara et al.

[11] Patent Number: 5,020,829

[45] Date of Patent: Jun. 4, 1991

[54] TWO-WAY COMMUNICATION SHEETS IN THE FORM OF DOUBLE POST CARD, DOUBLE LETTER SHEET, AND THE LIKE

[75] Inventors: Kenji Shibahara; Norio Houchin, both of Osaka, Japan

[73] Assignees: Kabushiki Kaisha Challenge Five; Evercoat Kabushiki Kaisha, both of Osaka, Japan

[21] Appl. No.: 479,409

[22] Filed: Feb. 13, 1990

[30] Foreign Application Priority Data

Jun. 14, 1989 [JP] Japan ..... 1-69437[U]

[51] Int. Cl.[5] ..... B42D 15/00

[52] U.S. Cl. ..... 283/62; 283/94; 283/106; 283/901; 281/18

[58] Field of Search ..... 283/62, 901, 98, 99, 283/108, 116, 117; 281/2, 5, 14, 51

[56] References Cited

U.S. PATENT DOCUMENTS 4,616,852 10/1986 Cash ..... 283/62

4,781,322 11/1988 Hunm ..... 283/62

*Primary Examiner*—Paul A. Bell

*Attorney, Agent, or Firm*—Koda and Androlia

[57] ABSTRACT

The invention relates to a two-way communication sheet in the form of double post card, double letter sheet, or the like for use in communicating under cover written information and the like which should be protected from disclosure. The two-way communication sheet is so arranged that a sheet portion on which information is written is bonded to other sheet portion or portions when the communication sheet is initially forwarded as well as when it is sent in reply, so that the information is prevented from being exposed outside. The communication sheet is quite novel in that it enables information to be communicated in secret condition.

4 Claims, 17 Drawing Sheets

TWO-WAY COMMUNICATION SHEETS IN THE FORM OF DOUBLE POST CARD, DOUBLE LETTER SHEET, AND THE LIKE

BACKGROUND OF THE INVENTION

1. Field of the Invention

This invention related to a two-way communication sheet in the form of double post cards, double letter sheet, or the like for use in communicating under cover written information and the like which should be protected from disclosure.

2. Describtion of Background Art

Hitherto, a commercially available double post card of the type which is shown in FIG. 10 has been known as a medium for two-way communication.

Such post card, as generally shown in (a) and (b) of that figure, comprises a first sheet portion 1 for writing by original sender and a second sheet portion 2 for writing in reply, the two sheet portions being connected in series. Further, the second sheet portion is intended to be preprinted with the name and address of the reply receiver. In this way, the double post card is mainly intended to serve for the convience of the replier by prepaying postage and reducing the trouble of the replier in reply writing by preaddressing at or before the time of the double post card being forwarded. However, as can be seen from (c) and (d) of the figure, such double post card is not intended to prevent the content of the communication from exposure, it being simply folded double without having the first and second sheet portions 1, 2 sticked together by pasting or otherwise when it is initially sent, as well as when it is sent for reply.

SUMMARY OF THE INVENTION

As stated above, such known double post card is not intended to avoid exposure of the content of the communication either in the forward course of mail or in the return course of mail. Therefore, the content of the communication is exposed to the risk of being disclosed to the outside, which poses a serious problem from the standpoint of secrecy. With so-called letter sheets, it is possible to prevent the content of the communication from being exposed to the risk of disclosure, usually by sealing. Primarily, however, such letter sheet is not intended for two-way communication.

This invention is directed to solving the foregoing problems, and it is an object of the invention to provide a two-way communication sheet in the form of double post card, double letter sheet, or the like which enables positive and easy protection from disclosure and, in turn, maintenance of secrecy with respect to the content of the communication in the course of mail, both ways.

In order to accomplish this object, according to the invention there is provided a two-way communication sheet in the form of double post card, double letter sheet, or the like which is well adapted for forward and return communication, comprising a sheet body 5 consisting of at least two sheet portions, a forward addressing section 19 for indication of the name, address, etc. of an addressee and a reply addressing section 20 which are individually provided on two of the front and back surfaces of said at least two sheet portions, an information writing section 10 for giving written information or the like which is provided on at least one of the surfaces of the sheet portions other than those on which said forward addressing section 19 and reply addressing section 20 are provided, the sheet portion having said information writing section 10 being adapted for adhesion to the other sheet portion with said information writing section 10 placed on the inner side in order to conceal the infornation writing section 10.

As stated above, the two-way communication sheet of the invention is designed so that one sheet portion having the information writing section for giving written information or the like is bonded to the other sheet portion in order to prevent the information writing section from being exposed in the forward and return courses of mail. Therefore, the possibility of the information contained therein being communicated in exposed state as in the case of conventional double post cards is eliminated, necessary information being completely concealed through bonding together of the sheet portions. Thus, according to the invention it is now possible to provide a very novel two-way communication sheet which enables information to be communicated in secret condition.

BRIEF DESCRIPTION OF THE DRAWINGS

FIG. 1(*a*) is a front view; FIG, 1(*b*) is a rear view; FIG. 1(*c*) is a perspective view of the double post card when initially sent; FIG. 1(*d*) is a front view of the card when sent in reply; FIG. 1(*e*) is a section taken along line A—A in FIG. 1(*d*); FIG.(*f*) is a section taken along line B—B in FIG. 1(*d*); and FIG. 1(*g*) is an enlarged section of portion C in FIG. 1(*e*);

FIG. 2(*a*) is a front view; FIG. 2(*b*) is a rear view; FIG. 2(*c*) is a front view of the double post card when initially sent; FIG. 2(*d*) is a section taken along lines D—D in FIG. 2(*c*); FIG. 2(*e*) is a front view of the card when sent in reply; and FIG. 2(*f*) is a section taken along line E—E in FIG. 2(*e*);

FIG. 3(*a*) is a front view; FIG. 3(*b*) is a rear view; FIG. 3(*c*) is a front view of the double post card when initially sent; FIG, 3(*d*) is a section taken along line F—F in FIG. 3(*c*); FIG. 3(*e*) is a front view of the card when sent in reply; and FIG. 3(*f*) is a section taken along line G—G in FIG. 3(*e*);

FIG. 4(*a*) is a front view; FIG. 4(*b*) is a rear view; FIG. 4(*c*) is a front view of the double card when initially sent; FIG, 4(*d*) is a section taken along line H—H in FIG. 4(*c*); FIG.(*e*) is a front view of the card when sent in reply; and FIG. 4(*f*) is a section taken along line I—I in FIG. 4(*e*);

FIG. 5(*a*) is a front view; FIG. 5(*b*) is a rear view; FIG. 5(*c*) is a front view if the double letter sheet when initially sent; FIG. 5(*d*) is a section taken along line J—J in FIG. 5(*c*); FIG. 5(*e*) is a front view of the letter sheet when sent in reply; and FIG. 5(*f*) is a section taken along line K—K in FIG. 5(*e*);

FIG. 6(*a*) is a front view; FIG. 6(*b*) is a rear view; FIG. 6(*c*) is a front view of the double letter sheet when initially sent; FIG. 6(*d*) is section taken along the line L—L in FIG. 6(*c*); FIG. 6(*e*) is a front view of the letter sheet when sent in reply; FIG. 6(*f*) is a section taken along line M—M in FIG. 6(*e*);

FIG. 7(*a*) is a view; FIG. 7(*b*) is a rear view;

FIG. 7(*c*) is a front view of the double letter sheet when initially sent; FIG. 7(*d*) is a section taken along line N—N in FIG. 7(*c*); FIG. 7(*e*) is a front view of the letter sheet when sent in reply; and FIG. 7(*f*) is a section taken along line O—O in FIG. 7(*e*);

FIG. 8(*a*) is a front view; FIG. 8(*b*) is a rear view; FIG. 8(*c*) is a front view of the doublw letter sheet when initially sent; FIG. 8(*d*) is a section taken along line P—P in FIG. 8(*c*); FIG. 8(*e*) is a front view of the letter sheet when sent in reply; and FIG. 8(*f*) is a section taken along line Q—Q in FIG. 7(*e*);

FIG. 9(*a*) is a front view; FIG. 9(*b*) is a rear view; FIG. 9(*c*) is a front view of the double letter sheet initially sent; FIG. 9(*d*) is a section taken along line R—R in FIG. 9(*c*); FIG. 9(*e*) is a front view of the letter sheet when sent in reply; and FIG. 9(*f*) is a section taken along line S—S in FIG. 7(*e*); FIG. 10(*a*) is a front view; FIG . 10(*b*) is a rear view; FIG. 10(*c*) is a perspective view of the double post card when initially sent; and FIG. 10(*d*) is a perspective view of same when sent in reply.

DETAILED DESCRIPTION OF THE PREFERRED EMBODIMENTS

Figure 1A:
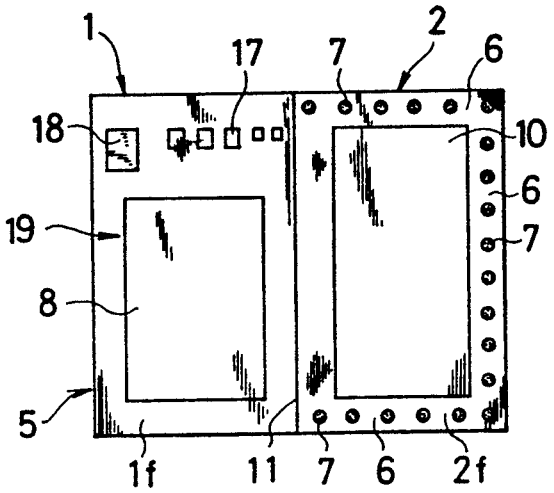
FIG. 1 illustrates one embodiment representing a double post card.
Figure 1B:
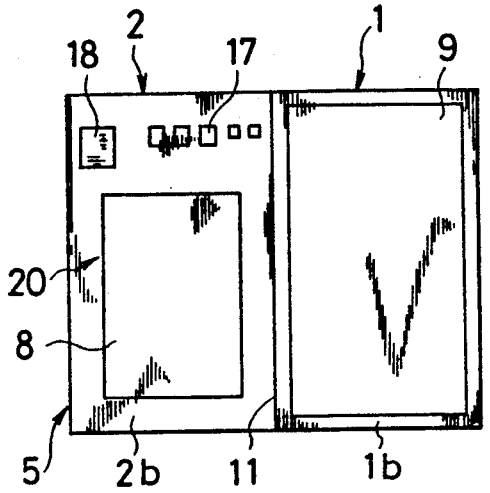
Figure 1C:
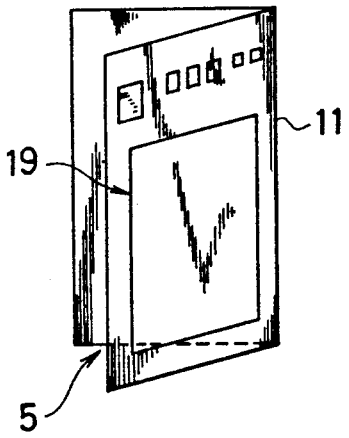
Figure 1D:
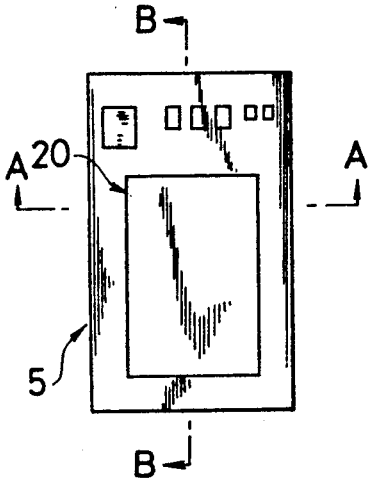
Figure 1E:
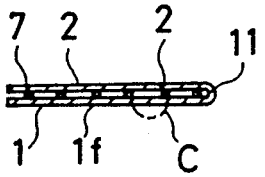
Figure 1F:
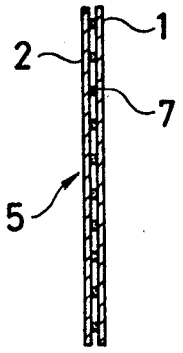
Figure 1G:
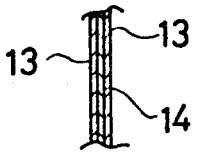

Various embodiments of the invention will now be described with reference to the accompanying drawings.

Embodiments 1 through 4 exemplify preferred forms of double post cards which represent one type of two-way communication sheet; and embodiments 5 through 9 exemplify preferred form of double letter sheets which represent another type of two-way communication sheet.

In the following embodiments, a two-way communication sheet comprises a plurality of sheet portions and each sheet portion has a front surface and a back surface; and therefore, for the convenience of description, it is understood that the term "front surface" of sheet body 5 and of individual sheet portions of the sheet body 5 means a surface connected in series with the surface of a sheet portion having above mentioned forward addressing section 19, whereas the term "back surface" means a surface of the opposite side relative to the front surface.

Embodiment No. 1

FIG. 1 illustrates one form of double post card as example of the two-way communication sheet. In the figure, (a) is a front view; (b) is a rear view; (c) is a perspective view of the double post card seen when it is initially forwarded; (d) is a front view of same when it is sent in reply; (e) is a section taken along line A—A in (d); (f) is a section taken along line B—B in (d); and (g) is an enlarged section of portion C in (e).

In FIG. 1, numeral 5 designates a sheet body which, as (a) and (b) of the figure show, comprises sheet portions 1, 2 of same post card size which are to be folded along a folding line 11.

On the front surface side 1*f* of the sheet portion 1 there is provided a forward addressing section 19 including a "forward" indication column 16, a postal code number frame 17, a postage stamp frame 18, and an addressing space 8 for the name and address of an addressee, and on the front surface side 2*f*of the sheet portion 2 thereis provided an information writing section 10 for giving information to the addressee. Further, the front surface side 2*f* of the sheet portion 2 is provided with a hot-melt type adhesive 7 applied in dotted pattern along three peripheral edge portions 6, 6, 6.

On the back surface side 1*b* there is provided an advertisement section 9 for entry of a sender's advertisement, and on the back surface side 2*b* there is provided a reply addressing section 20 including a "reply" indication column 16, a postal code number frame 17, a postage stamp frame 18, and an addressing space 8 for the name and address of a addressee of the reply.

Additionally, as shown in (g) of FIG. 1, the sheet body 5 is of a three layer construction with an aluminum deposited film 14 interposed between two sheets of paper 13*a* and 13*b*.

In using the double post card of the above described construction, the sheet portions 1, 2 are folded along the folding line 11 as shown in (c) of the figure so that the forward addressing section 19 of the sheet portion 1 is positioned outside, when the double post card is initially sent as a two-way card 5.

In this case, the information writing section 10 on the front surface side 2*f* of the sheet portion is exposed outside, but for the purpose of initial forwarding, there is no trouble even if the double post card is sent with the information writing section 10 exposed outside, unless it is necessary to keep the information secret from the outside.

The receiver of the double post card so forwarded opens the folded double post card 5 and writes the required information in the information writing section 10 of the sheet portion 2, the post card being then returned to the initial sender.

When returning, as (d) to (f) of FIG. 1 show, the sheet body 5 is folded double along the folding line in manner reverse to the initial way of folding, so that the reply addressing section 20 is positioned outside.

In this case, the front surface side 1*f* of the sheet portion 1 and the front surface side 2*f* of the sheet portion 2 are bonded together with the adhesive 7 by heating, the information writing section 10 being thus concealed. The double post card 5 of the present embodiment has an advantage that for the purpose of return the sheet portions 1, 2 are bonded together, so that the information writing section 10 of the sheet portion 2 is completely consealed by the sheet portions 1, 2. Therefore, the information written in the information writing section 10 is completely kept in secret in the return course of mail and otherwise.

Furthermore, the sheet body 5 is constructed of two sheets of paper 13*a* and 13*b* and an aluminum deposited film 14 interposed between them, which fact assures that the information contained in the interior will never be externally seen through and accordingly that the information can be more positively maintained in secret.

The information writing section 10 in this embodiment is used for writing a questionaire from the sender to the receiver when it is to be forwarded, and for writing a reply to the questionaire in conjunction therewith when it is to be returned to the sender. Therefore, even if the information writing section 10 is exposed outside in the forward course of mail, there is no particular inconvenience from the standpoint of secrecy, because the questionaire is yet to be answered.

As will be appreciated from the above description, this embodiment represents a novel double post card 5 which enables information from a replier to a sender to be kept in secret and yet which is simple in construction such that it is formed of one sheet body 5 only.

Embodiment No. 2

This is another form of double post card in which the card comprises three sheet portions.

Figure 2:
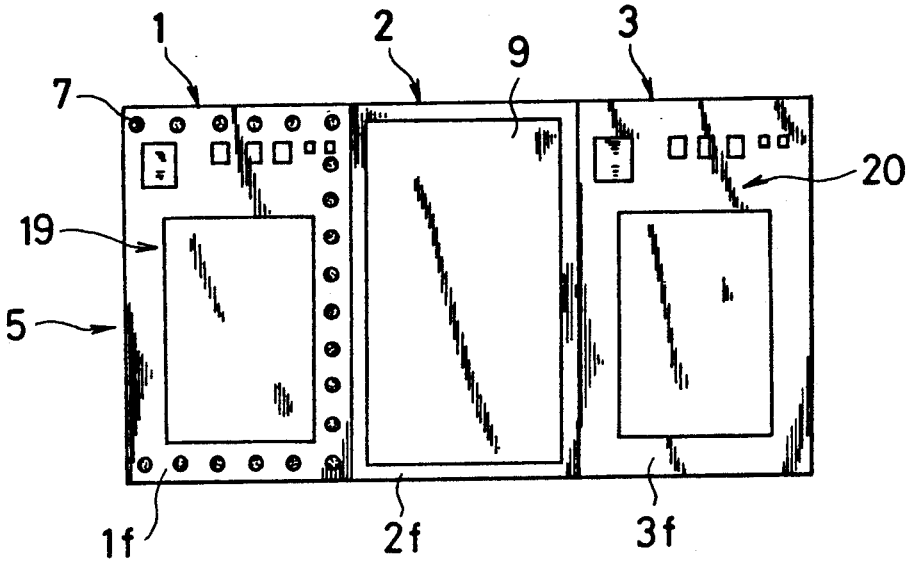
FIG. 2 illustrates another embodiment of the double post card.
Figure 2:
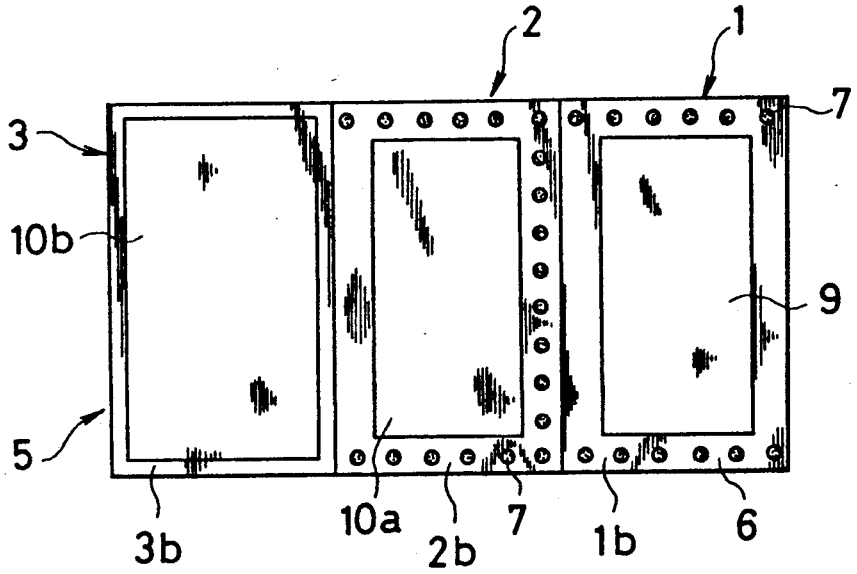
Figure 2:
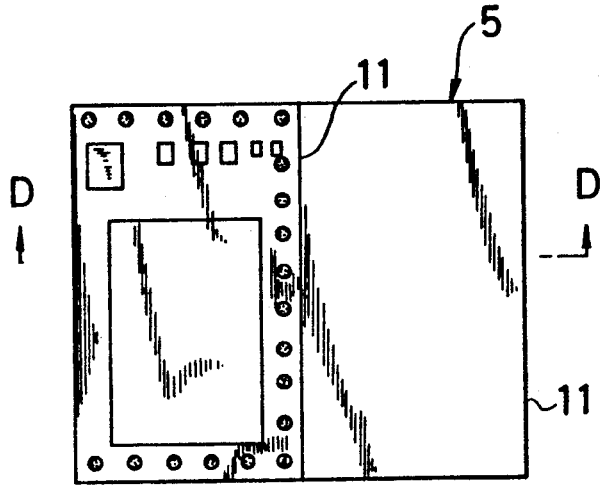
Figure 2:
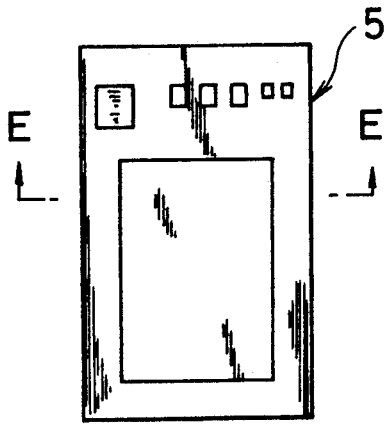
Figure 2:
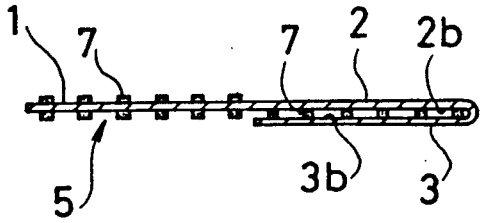
Figure 2F:
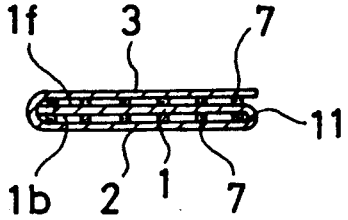

In this embodiment, the sheet body 5 is constructed of three sheet portions 1, 2, 3 of same post card size as shown in (a) and (b) of FIG. 2.

A forward addressing section 19 is provided on the front surface side 3*f* of the sheet portion 3, and an information writing section 10*a* for information from the sender to the receiver and an information writing section 10*b* for information from the receiver to the sender are provided respectively on the back surface side 2*b* of the sheet portion 2 and on the back surface side 3*b* of the sheet portion 3. Adhesive 7 is provided in dotted pattern along three peripheral edge portions on the front surface side 1*f* of the sheet portion 1 and along two peripheral edge portions, upper and lower, on the back surface side 1*b* of the sheet portion 1, and further along three peripheral edge portions on the back surface side 2*b* of the sheet portion 2. An advertisement section 9 is provided on the back surface side 1*b* of the sheet portion 1 and also on the front surface side 2*f* of the sheet portion 2.

For use the double post card of the above described construction, at the time of forwarding, as (c) and (d) of FIG. 2 show, the sheet portion 3 is folded along a folding line 11 toward the back surface side of the sheet portion 2 so that the information writing sections 10*a*, 10*b* are positioned inside, and the sheet portions 2 and 3 are bonded together by means of the adhesive 7 provided on the back surface side 2*b* of the sheet portion 2. The double post card is then forwarded in the so bonded condition.

The receiver of the double post card forwarded by the sender can readily open the card by hand since bonding of sheet portions has been effected merely in dotted fashion along peripheral edge portions, After the content of the information writing section 10*a* has been read, necessary information is written in the information writing section 10*b*, the card being then sent for return.

For the purpose of return, the sheet portion 1 is first bonded to the sheet portion 2 through the adhesive 7 provided along the two peripheral edge portions, upper and lower, on the back surface side 1*b* of the sheet portion 1. In this case, the adhesive 7 provided along the upper and lower peripheral edge portions is sufficient for the purpose of bonding, because the sheet portions 1 and 2 are folded toward each other along the folded line 11 as shown in (f) of FIG. 2.

Then, the sheet portion 3 is folded toward the sheet portion 1 and bonded thereto by means of the adhesive 7 provided along three peripheral edge portions on the front surface side 1*f* sheet portion 1. Thus, the sheet body 5 can be sent in an inwardly triplefolded fashion as shown in (f) of FIG. 2.

An invitation from the sender to the reveiver for purchase, or the like may be written in the information writing section 10*a*, and a reply of the receiver to the sender, for example, willingness to buy or otherwise, quantity of order, and method of payment, may be written in the information writing section 10*b*.

In the double post card of the present embodiment, the information writing section 10*a* for information from the sender to the receiver and the information writing section 10*b* for information from the receiver to the sender are concealed because the respective surfaces of the sheet portions having the information writing sections 10*a*, 10*b* are bonded together so that they are positioned inside when the post card is forwarded as well as it is sent in reply. Therefore, any information requiring secrecy will never be exposed outside. Further, in this embodiment, there are provided two information writing sections 10, namely, one for information from the sender and the other for information from the replier, as described above; therefore, as compared with the previously described embodiments No. 1, a greater amount of information can be written both on the sender's side and the replier's side and thus such increased amount of information can be communicated in secret between the both parties.

Embodiment No. 3

Figure 3A:
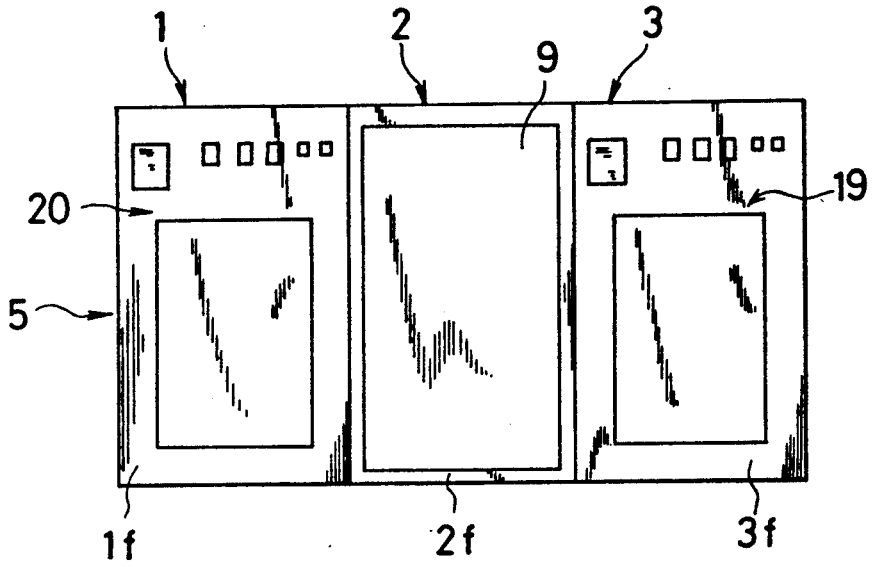
FIG. 3 illustrates another embodiment of the double post card.
Figure 3B:
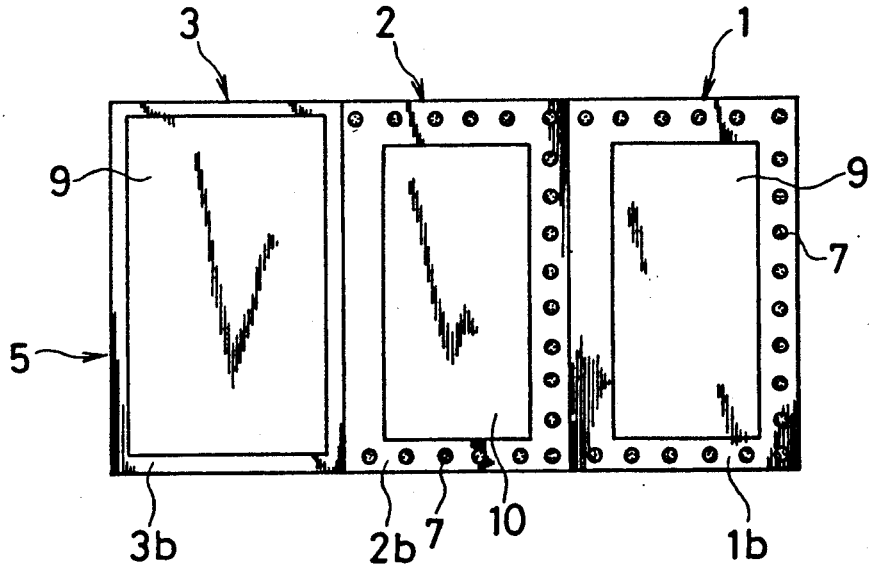
Figure 3:
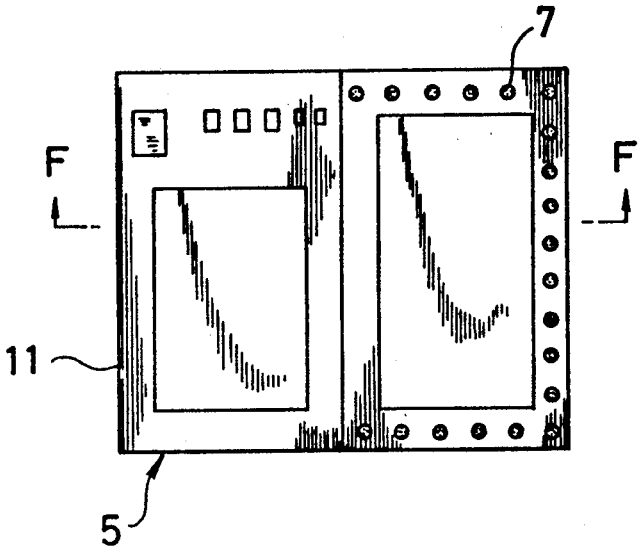
Figure 3:
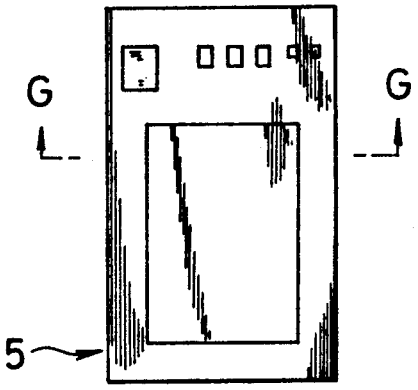
Figure 3:
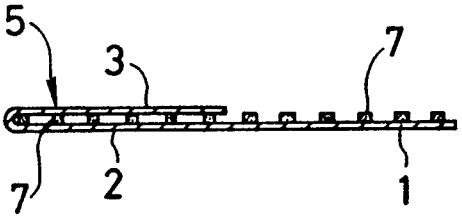
Figure 3:
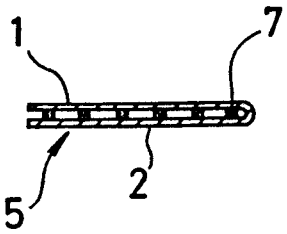

This embodiment represents another form of double post card which, as FIG. 3 shows, is similar to embodiment No. 2 in that it has three sheet portions 1, 2, 3 and in the information writing section is consealed for both forwarding and reply purposes, but is different from embodiment No. 2 in that sheet portion 3 is separated upon receipt by the receiver so that the card body has only two sheet portions 1, 2 when it is returned.

In this embodiment, as (f) of FIG. 3 shows, the sheet portion 3 having a forward addressing section 19 is separated and discarded upon receipt by the receiver, the sheet portions 1 and 2 are sent back after being folded toward each other and bonded together so as to conseal the information writing section 10.

Referring to other construction features of the embodiment, a reply addressing section 20 is provided on the front surface side 1*f* of the sheet portion 1 and a forward addressing section 19 is provided on the front surface 3*f* of the sheet portion 3, which arrangment is contrary to that of embodiment No. 2. Information writing section 10 is provided only on the back surface side 2*b* of the sheet portion 2, and advertisement section 9 are individually provided on three surface sides, namely, back surface side 1*b* of the sheet portion 1, front surface side 2*f* of the sheet portion 2,a and back surface side 3*b* of the sheet portion 3. Adhesive 7 is provided along three peripheral edge portions on the back surface side 1*b* of the sheet portion 1 and on the back surface side 2*b* of the sheet portion 2.

Embodiment No. 4

Figure 4:
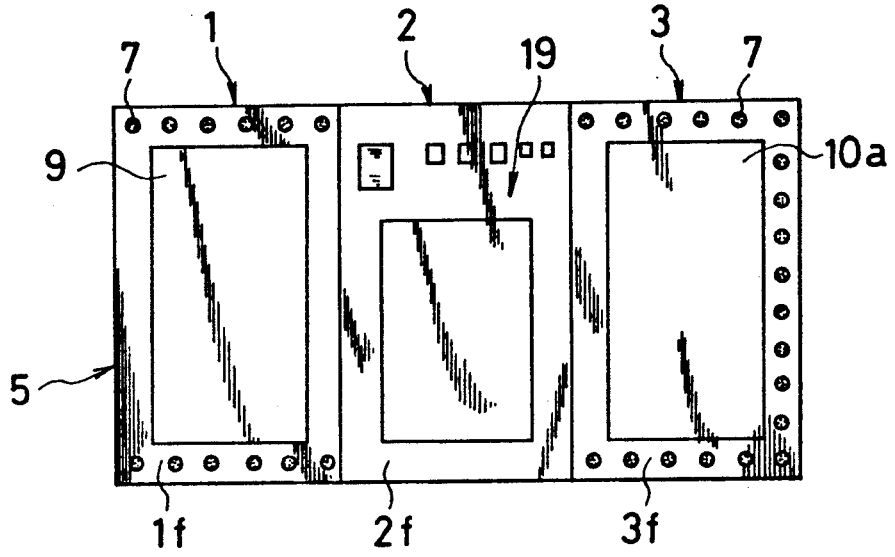
FIG. 4 illustrates another embodiment of the double post card.
Figure 4:
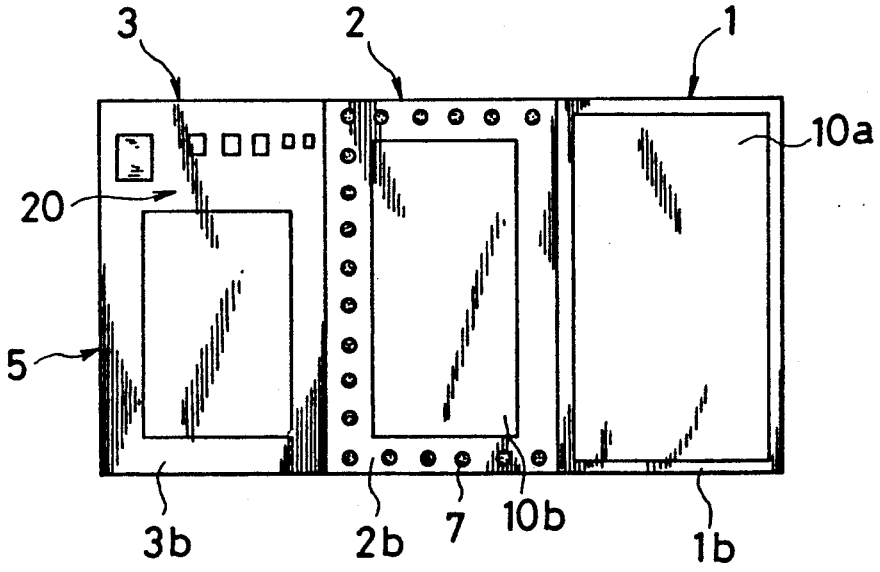
Figure 4:
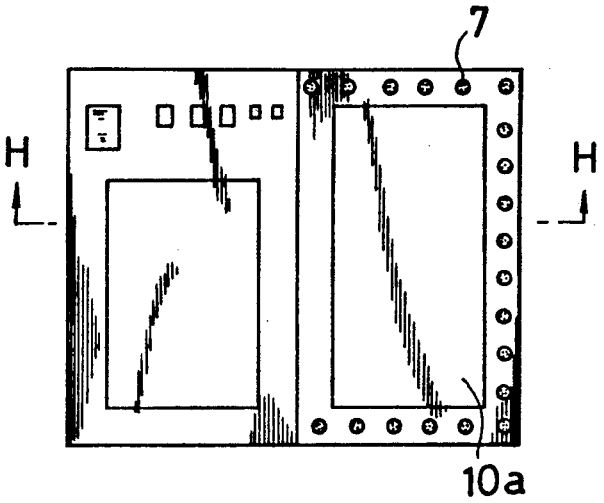
Figure 4:
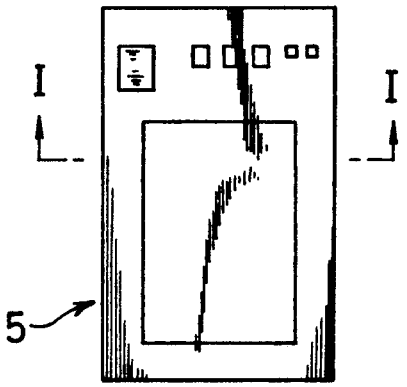
Figure 4D:
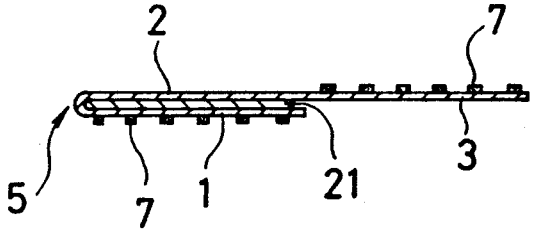
Figure 4F:
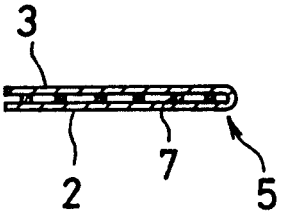
Figure 5A:
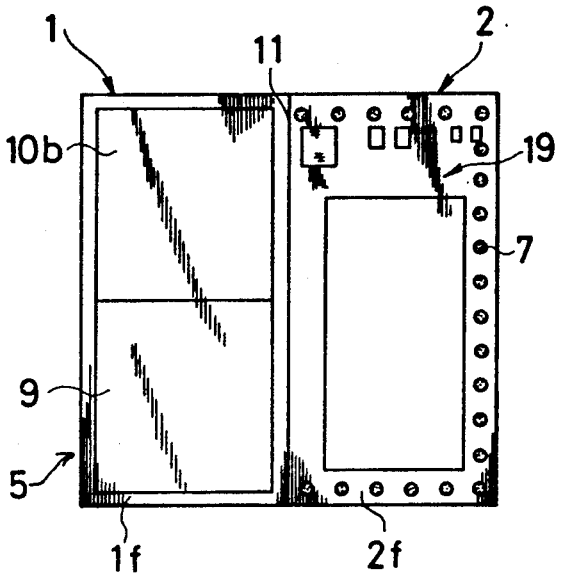
FIG. 5 illustrates one embodiment representing a double letter sheet.
Figure 5B:
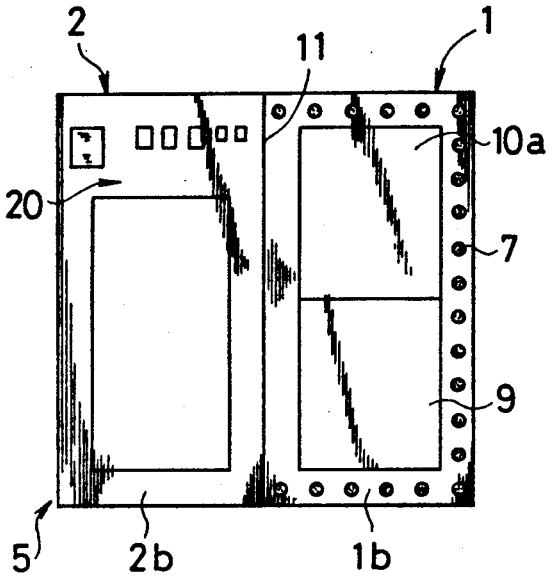
Figure 5C:
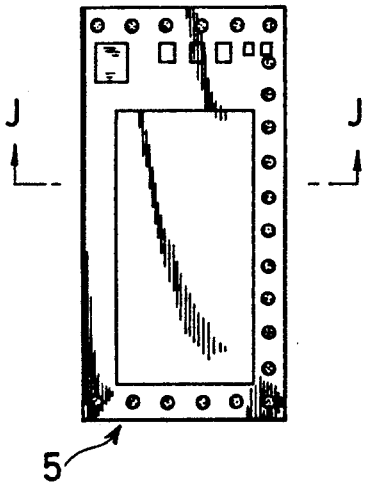
Figure 5E:
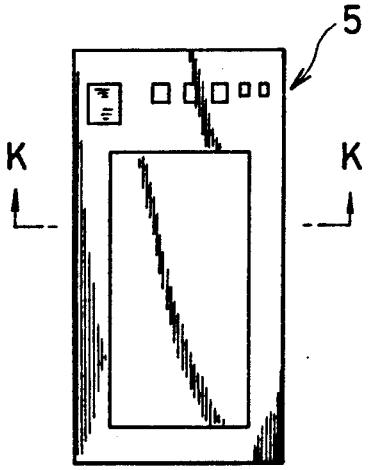
Figure 5D:
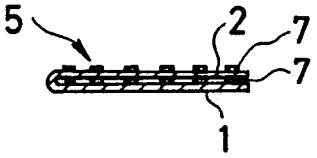
Figure 5F:
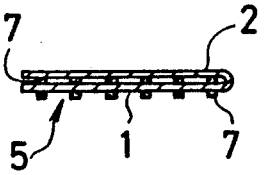
Figure 6A:
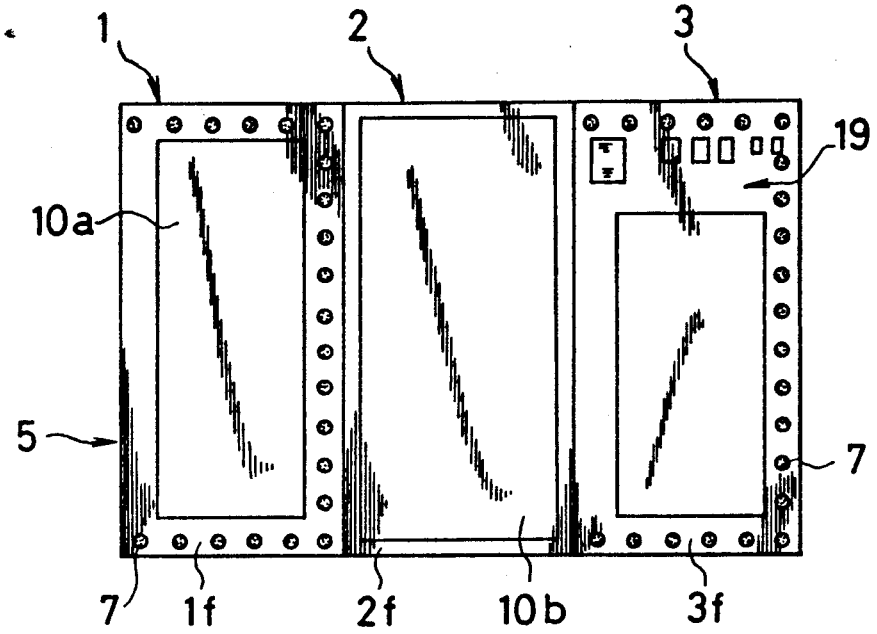
FIG. 6 illustrates another embodiment of the double letter sheet.
Figure 6B:
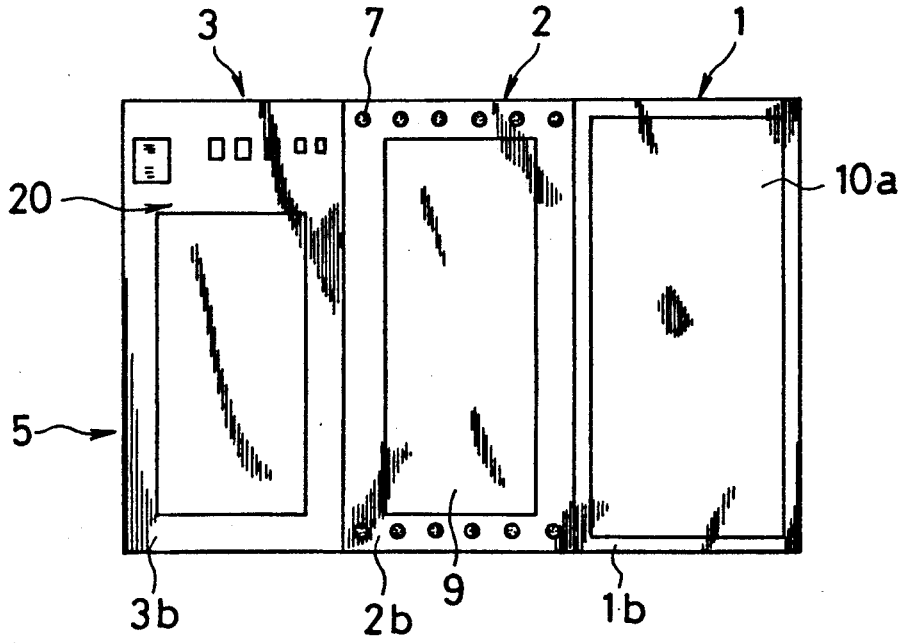
Figure 6C:
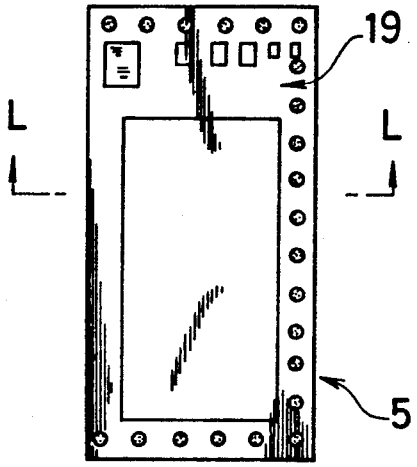
Figure 6E:
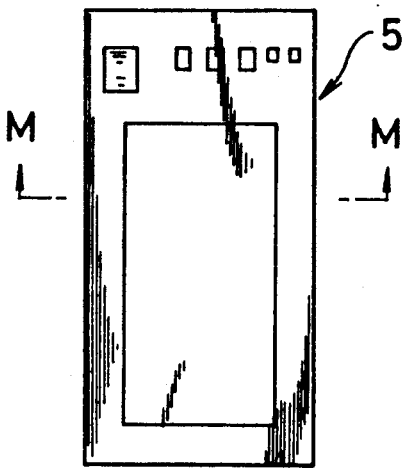
Figure 6D:
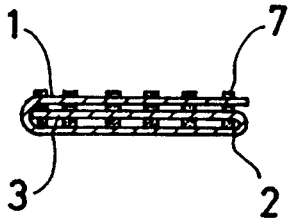
Figure 6F:
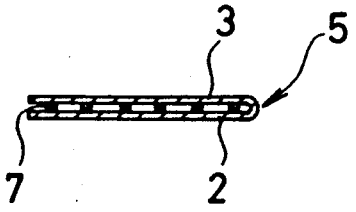
Figure 7A:
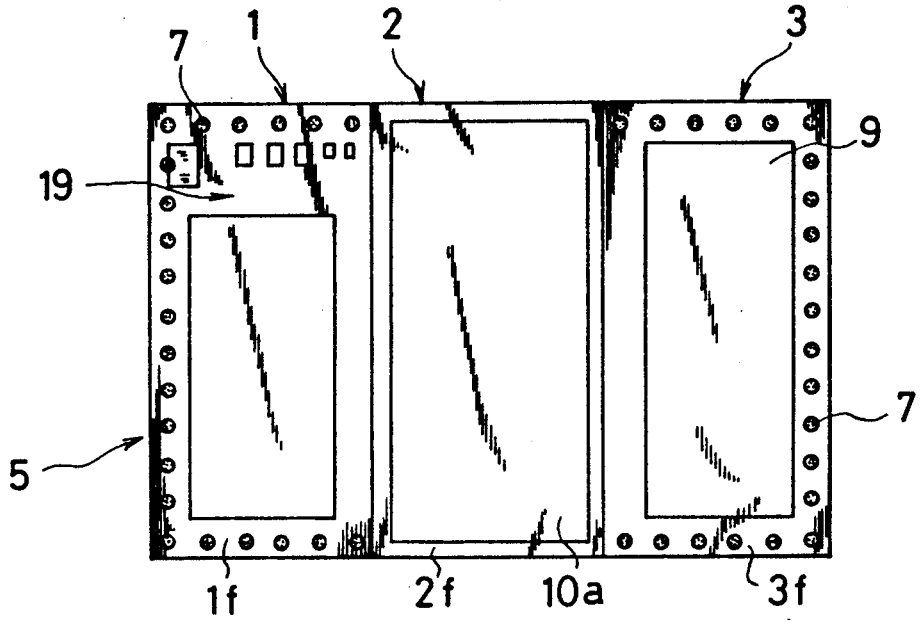
FIG. 7 illustrates another embodiment of the double letter sheet.
Figure 7B:
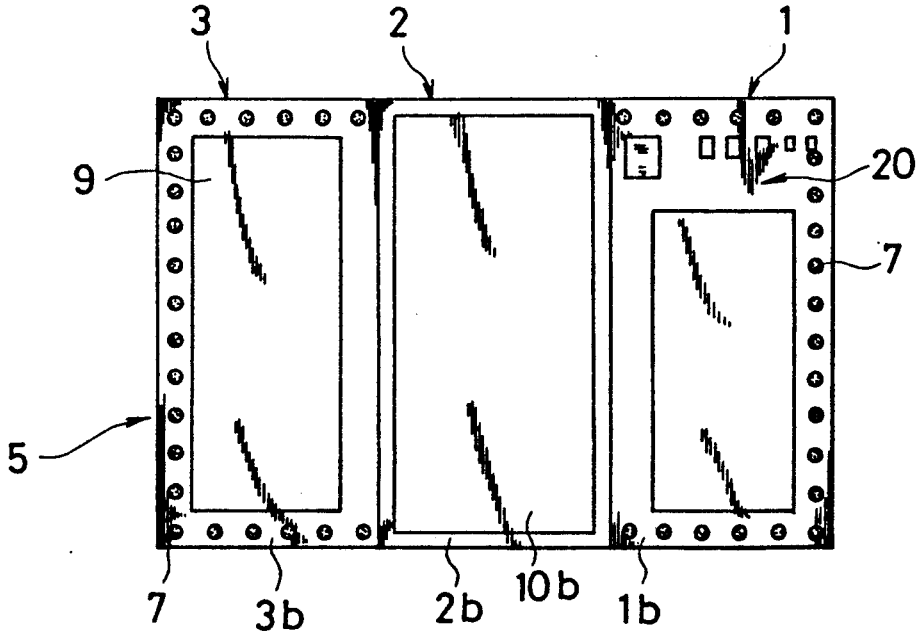
Figure 7C:
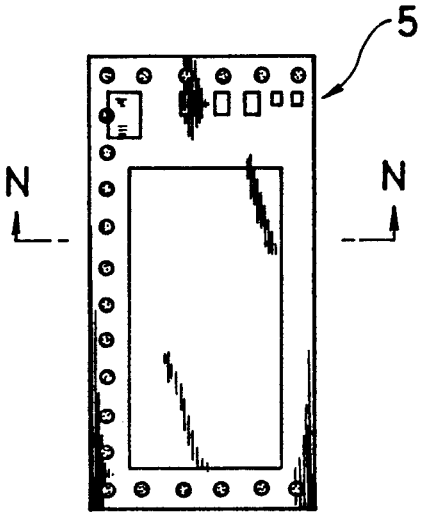
Figure 7E:
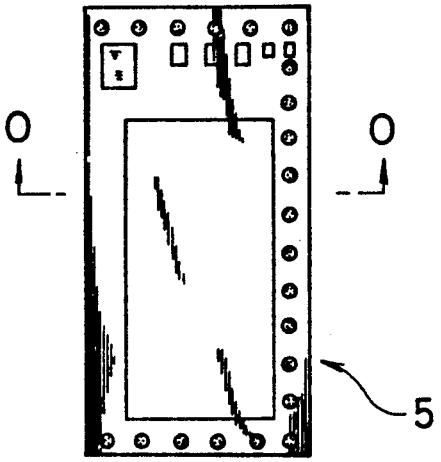
Figure 7D:
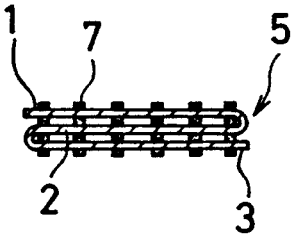
Figure 7F:
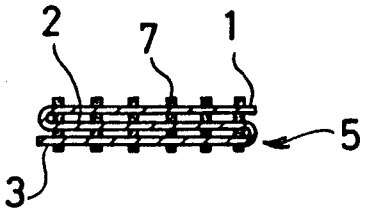

This embodiment is another form of double post card which, as FIG. 4 shows, is similar to Embodiment Nos. 2 and 3 in that it has three sheet portions 1, 2, 3 but is different from them in that it is adapted to enclose a telephone card when the post card is forwarded.

In this embodiment, it is arranged that as (d) of FIG. 4 shows, the post card is forwarded with a telephone card 21 interposed between opposed sheet portions 1 and 2 of the sheet body 5 in folded condition.

In this embodiment, the forward addressing section 19 is provided on the front surface 2*f* of the sheet portion 2 and the reply addressing section 20 is provided on the back surface side 3*b* of the sheet portion 3; information writing sections 10*a*, 10*b*,and 10*c* are provided respectively on the front surface side 3*f* of the sheet portion 3, on the back surface side 2*b* of the sheet portion 2, and on the back surface side 1*b* of the sheet portion 1; and advertisement section 9 is provided on the front surface side 1*f* of the sheet portion 1.

Adhesive 7 is provided along three peripheral edge portions on the front surface side 3*f* of the sheet portion 3 and similarly on the back surface side 2*b* of the sheet portion 2, and also along two peripheral edge portions, upper and lower, on the front surface side 1*f* of the sheet portion 1.

According to this embodiment, the sender can communicate a large amount of information through the information writing sections and 10*c* and, at same time, can send a telephone card 21, while the receiver of the post card forwarded by the sender can send any reasonably desired information to the initial sender through the information writing section 10*b*.

A cash card or the like may be enclosed instead of the telephone card 21. The only condition for such enclosure is that the item to be enclosed is reasonably flat.

Embodiment No. 5

FIG. 5 shows one form of double letter sheet as an example of two-way communication sheet.

In FIG. 5, numeral 5 designates a sheet body consisting of two sheet portions 1, 2 of same size connected to each other via a folding line 11. In this respect, the double letter sheet is similar in construction to the double post card of Embodiment No. 1. However, this embodiment is different from Embodiment No. 1 in that the sheet portions 1 and 2 are folded toward each other and bonded together when the letter sheet is initially forwarded. Accordingly, the letter sheet is forwarded in such condition that the information writing section 10*a* for information from the sender to the receiver is not exposed outside.

In this embodiment, for both forward and return mail purposes, the letter sheet is designed for mailing in the form of an ordinary letter and not as a double post card, and in this sense it can serve as a novel means for two-way communication.

In the present embodiment, as (a) through (e) of FIG. 5 illustrate, a forward addressing section 19 is provided on the front surface side 2*f* of the sheet portion 2, and a reply addressing section 20 is provided on the back surface side 2*b* of the sheet portion 2. An information addressing section 10*a* for information from the sender to the receiver and an information addressing section 10*a* for information from the receiver to the sender are respectively provided on the back surface side 1*b* of and on the front surface side 1*f* of the sheet portion 1, each occupying about one half area of the corresponding surface side. On the respective remaining portions of the surfaces 1*f*, 1*b* are provided advertisement sections for entry of advertisements by the sender. Adhesive 7 is provided over three peripheral edge portions on the front surface side 2*f* of the sheet portion 2 and likewise on the back surface side 1*b* of the sheet portion 1.

When the letter sheet is to be forwarded, as (c) and (d) of FIG. 5 show, the sheet portions 1 and 2 are bonded together by means of the adhesive 7 provided on the back surface side 1*b* of the sheet portion 1 so that the information writing portion 10*a* on the back surface side 1*b* of the sheet portion 1 is positioned inside. Thus, the secrecy of the information can be maintained. In this case, the information writing section 10*b* is exposed outside, but this involves no inconvenience whatever because that section 10*b* is yet to be filled by the receiver.

When the letter sheet is to be sent in reply, as (e) and (f) of the figure illustrate, the sheet body is folded reversewise of the way in which it was folded for the purpose of forwarding and is then subjected to bonding, and accordingly the information writing section 10*a* is exposed outside. However, since the information contained in that section is already out of use, the exposure thereof involves no particular inconvenience. On the other hand, the information writing section 10*b* is positioned inside and, therefore, no particular inconvenience is involved from the standpoint of secrecy.

Embodiment No. 6

FIG. 6 illustrates another form of double letter sheet as an example of two-way communication sheet.

This embodiment is different from Embodiment No. 5 in that the sheet body 5 consists of three sheet portions 1, 2, 3.

While the embodiment is similar to Embodiment Nos. 2 through 4 in that the sheet body consists of three sheet portions 1, 2, 3, it is different from those embodiments in that, as (c) and (d) of FIG. 6 show, the sheet body 5 is inwardly folded in three and adhesive-bonded when it is mailed by the sender, and in that, therefore, the forward addressing seciton 19 and the information writing section 10*b* for information from the receiver to the sender which is to be filled up are only exposed at the time of forward mailing.

At the time of return mailing, as (f) of FIG. 6 shows, after separation of one unrequired sheet portion, the sheet body is folded double and adhesive-bonded for return in same manner as in the case of Embodiment Nos. 3 and 4.

In this embodiments, the forward addressing section 19 is provided on the front surface side 3*f* of the sheet portion 3 and the return addressing section 20 is provided on the back surface side 3*b* of the sheet portion 3. The information writing sections 10*a*, 10*a* for information from the sender to the receiver are provided on the front surface side 1*f* and back surface side 1*b* of the sheet portion 1, and the advertisement section 9 for entry of an advertisement or the like is provided on the back surface side 2*b* of the sheet portion 2. Adhesive 7 is provided on the front surface side 1*f* of the sheet portion 1 and front surface side 3*f* of the sheet portion 3 along their respective three peripheral edge portions, and also on the back surface side 2*b* of the sheet portion 2 along two peripheral edge portions, upper and lower.

In the double letter sheet of this embodiments, as described above, the front and back surfaces of the sheet portion 1 are used for supply of information from the sender to the receiver and the both surfaces are concealed at the time of forward mailing. Therefore, a fair amount of information can be sent in secret. Whilst, the receiver of the information can use full space of the front surface side 2*f* of the sheet portion 2 as information writing section 10*b*.

Embodiment No. 7

FIG. 7 shows another form of double letter sheet. This embodiment is similar to Embodiment No. 6 in that it comprises three sheet portions, but is different therefrom in respect of the manner in which the sheet body 5 is folded at the time of forward mailing as well as at the time of return mailing.

In the present embodiment, as (d) of FIG. 7 shows, at the time of forward mailing the sheet body 5 is folded in three generally in Z-shaped pattern and adhesive-bonded so that the sheet portion 2 with an information writing section 10*a* for information from the sender to the receiver is held between the sheet portion 1 and the sheet portion 3, while at the time of return mailing, as (f) of the figure shows, the sheet body is folded in three in inverted Z-shaped pattern and adhesive-bonded for return so that the sheet portion 2 is held between the sheet portion 1 and the sheet portion 3.

In this embodiment, the forward addressing section 19 is provided on the front surface side 1*f* of the sheet portion 1 and the reply addressing section 20 is provided on the back surface side 1*b* of the sheet portion 1. Advertisement sections 9 for entry of advertisements or the like of the sender are provided on the front and back surface sides 3*f* and 3*b* of the sheet portion 3, and the information writing section 10*a* for information from the sender to the receiver is provided on the front surface side 2*f* of the sheet portion 2. The information writing section 10*b* for information from the receiver is provided on the back surface side 2*b* of the sheet portion 2. Adhesive 7 is provided on the front surface side 1*f* of the sheet portion 1, on the front surface side 3*f* of the sheet portion 3, on the back surface side 1*b* of the sheet portion 1, and on the back surface side 3*b* of the sheet portion 3, along their respective three peripheral edge portions.

In the double letter sheet of this embodiment, as described above, the information writing section 10*a* for information from the sender to the receiver and the information writing section 10*b* for information from the receiver to the sender are respectively provided on the front surface side and back surface side of same sheet portion, and this is particularly helpful for exchange of information between the sender and the receiver that will always require cross reference with respect to the information writing sections 10*a*, 10*b*, if the other sheet portions are lost. Further, at the time of forward mailing as well as at the time of return mailing, one of the advertisement sections 9 in which an advertisement of the sender is written is positioed outside, which affords considerable advertisement effect for the benefit of the sender.

In addition, the information writing sections 10*a* and 10*b* are positioned inside at the time of forward mailing as well as at the time of return mailing, which of course affords positive assurance of secrecy of information.

Embodiment No. 8

Figure 8:
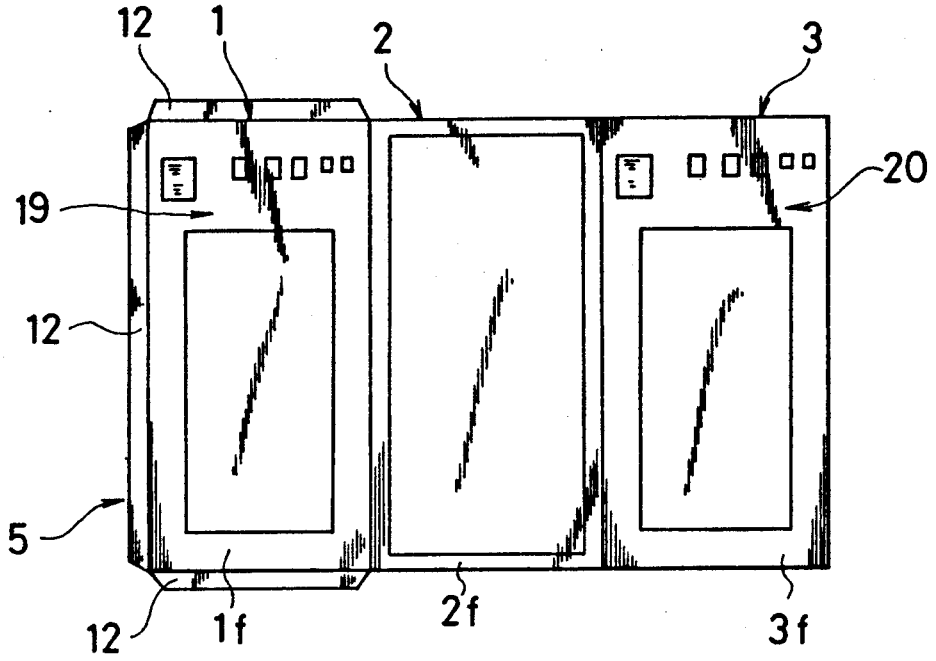
FIG. 8 illustrates another embodiment of the double letter sheet.
Figure 8:
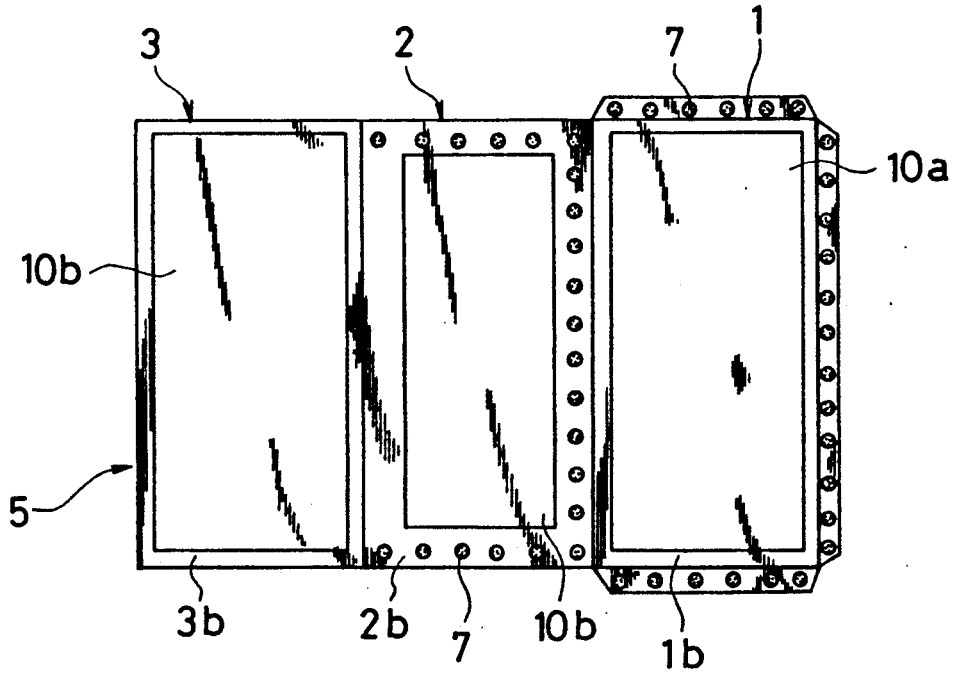
Figure 8C:
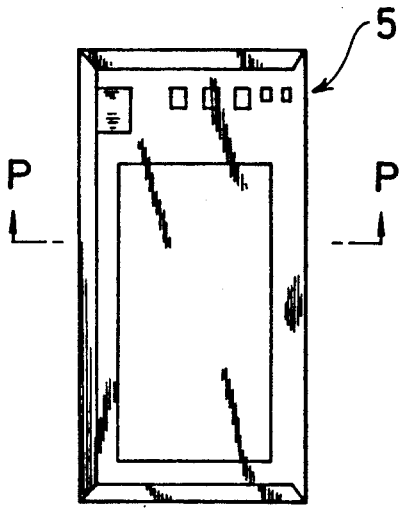
Figure 8E:
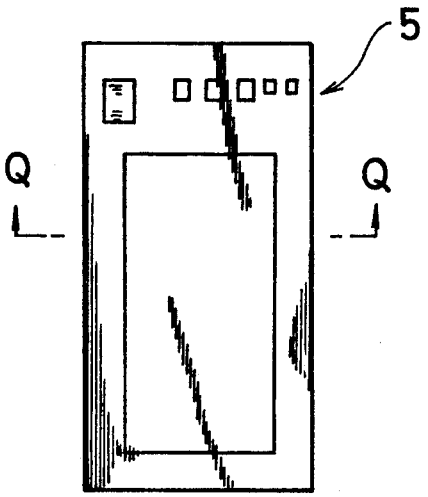
Figure 8D:
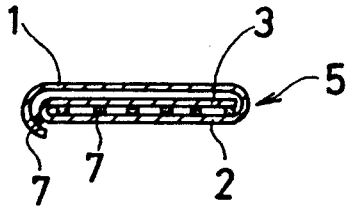
Figure 8F:
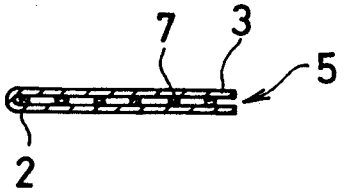
Figure 9A:
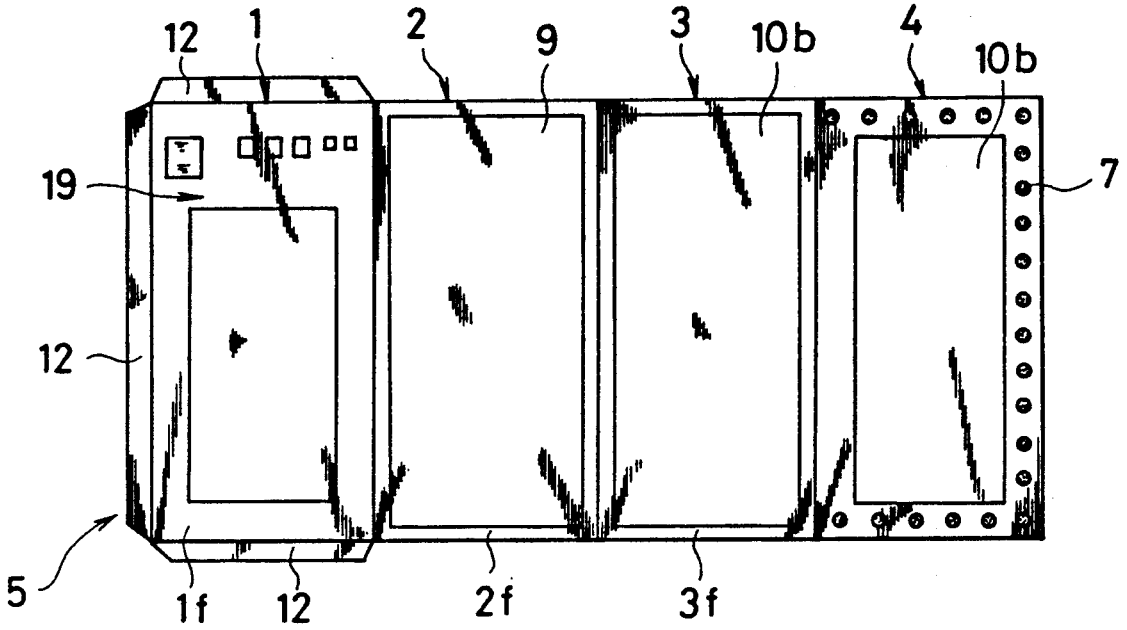
FIG. 9 illustrates another embodiment of the double letter sheet.
Figure 9B:
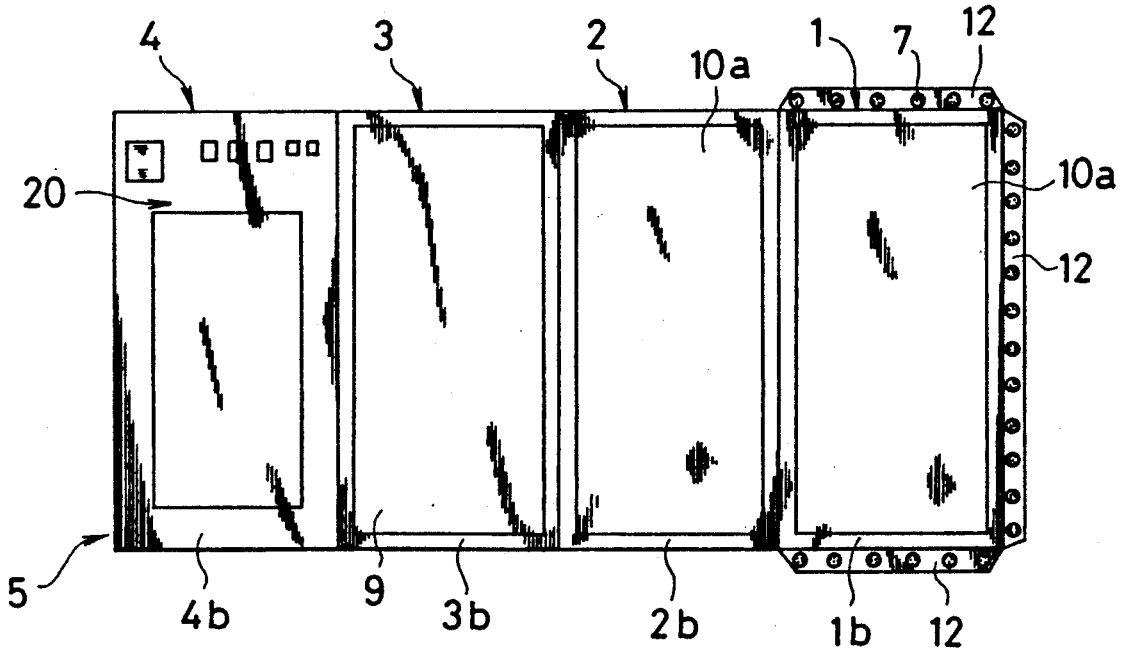
Figure 9C:
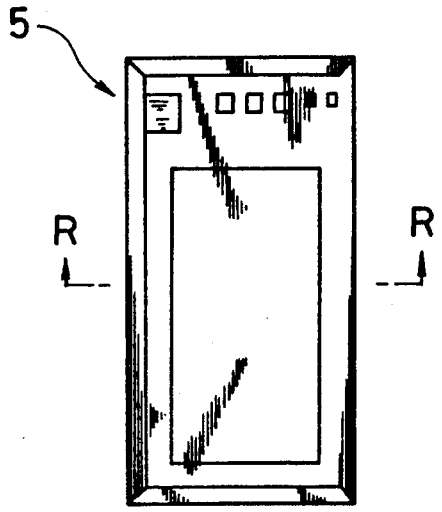
Figure 9E:
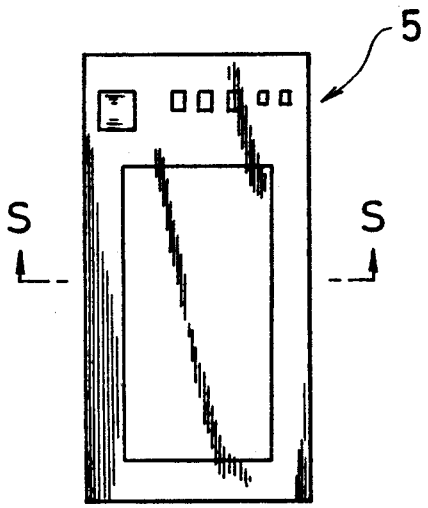
Figure 9D:
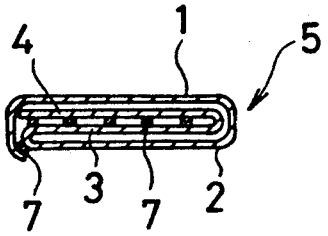
Figure 9F:
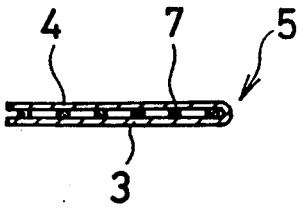
Figure 10:
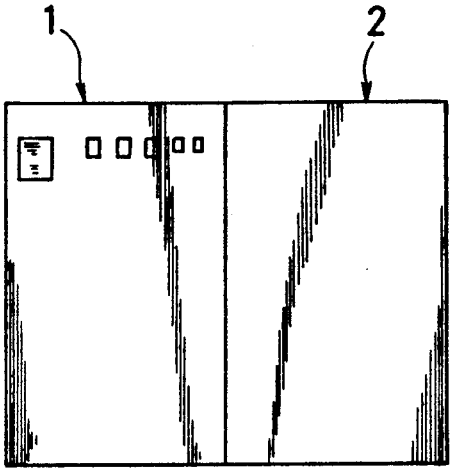
FIG.10 (a) (Prior Art)
FIG. 10 illustrates a conventional double post card.
Figure 10:
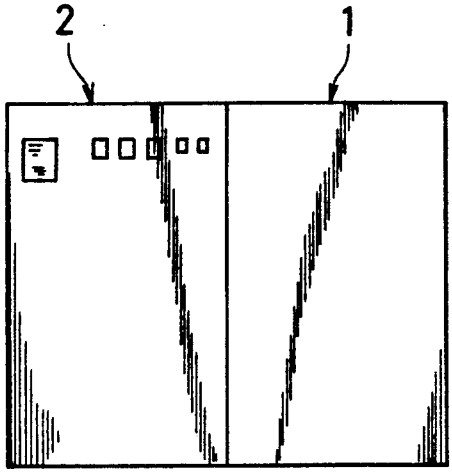
FIG.10 (b) (Prior Art)
Figure 10:
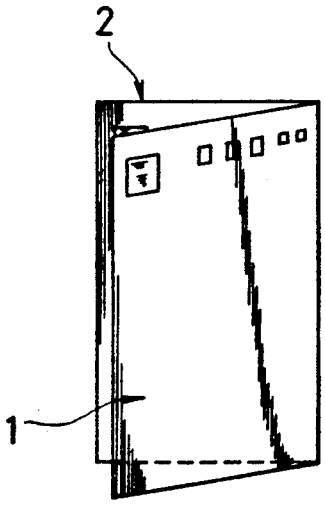
FIG.10 (c) (Prior Art)
Figure 10:
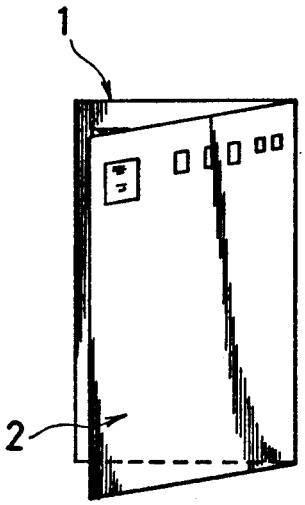
FIG.10 (d) (Prior Art)

FIG. 8 illustrates another embodiment of double letter sheet as an example of two-way communication sheet.

In FIG. 8, the sheet body 5 consists of three sheet portions 1, 2, 3 of same size formed in continuation, in which respect the present embodiment is similar to Embodiment No. 6. However, this embodiment is different from the foregoing embodiments in that of the three sheet portions, sheet portion 1 has edge projections 12, 12, 12 for sealing which project outwardly from three peripheral edge portions of the sheet portion, as shown in (a), (b) and (c) of FIG. 8.

In this embodiment, as (a) and (b) of the figure shows, the forward addressing section 19 is provided on the front surface side 1*f* of the sheet portion 1, and the reply addressing section 20 is provided on the front surface side 3*f* of the sheet portion 3. The information writing section 10 for information from the sender to the receiver and information writing sections 10*b*, 10*b* are respectively provided on the back surface sides 1*b*, 2*b*, and 3*b* of the sheet portions 1, 2 and 3. The advertisement section 9 for advertisement entry is provided on the front surface side 2*f* of the sheet portion 2.

Adhesive 7 is provided along three peripheral edge portions of the back surface side 2*b* of sheet portion 2 and also on the back surface side of the edge projections 12, 12, 12.

At the time of forward mailing, as (c) and (d) of FIG. 8 show, the sheet body is generally folded in three and edge projections 12, 12, 12 of the sheet portion 1 are folded to cover three peripheral edge portions of the front surface side 2*f* of the sheet portion 2; then, the edge projections 12, 12, 12 and the corresponding three peripheral edge portions of the front surface side 2*f* of the sheet portion 2 are bonded together by the adhesive 7 provided on the back surface side of the edge projections 12, 12, 12.

Since the edge projections which project from the sheet portion 1 are provided with adhesive as described above, such sealing by the edge projections affords some more space allowance for entry of information and the like as compared with the case where, as in the foregoing embodiments, adhesive is provided along peripheral edge portions of the relevant sheet portions per se. In addition, the edge projections 12, 12, 12 cover peripheral edge portions of the folded sheet body and accordingly the secrecy of the content of the communication can be more positively maintained.

Upon perusal of the content of the letter sheet from the sender, the receiver fills up the information writing sections 10*b*, 10*b* on the back surface sides 2*b*, 3*b* of the sheet portions 2, 3 by giving the required information and then separates the sheet portion 1 from the sheet body. Subsequently, as (e) and (f) of FIG. 8 show, the sheet portions 2 and 3 are folded toward each other and adhesive-bonded for return.

Embodiment No. 9

FIG. 9 illustrates another embodiment of double letter sheet as an example of two-way communication sheet.

In this embodiment, the sheet body 5 consists of four sheet portions 1, 2, 3, 4 of same size as shown in (a) and (b) of FIG. 9. Of the four sheet portions, sheet portion 1 has sealing edge projections 12, 12, 12 at three peripheral edge portions as in Embodiment No. 8.

In this embodiment, as (a) and (b) of FIG. 9 show, the forward addressing section 19 is provided on the front surface side 1*f* of the sheet portion 1, and the reply addressing section 20 is provided on the back surface side 4*b* of the sheet portion 4. Information writing sections 10*a*, 10*a* for information from the sender to the receiver and information writing sections 10*b*, 10*b* for information from the receiver to the sender are provided respectively on the back surface sides 1*b*, 2*b* of the sheet portions 1, 2 and on the front surface sides 3*f*, 4*f* of the sheet portions 3, 4. Advertisement sections 9 for entry of advertisements are provided on the front surface side 2*f* of the sheet portion 2 and on the back surface side 3*b* of the sheet portion 3. Adhesive 7 is provided along three peripheral edge portions of the front surface side 4*f* of the sheet portion 1 and also on the back surface side of edge projections 12, 12, 12 of the sheet portion 1.

At the time of forward mailing, as (c) and (d) of FIG. 9 show, the four sheet portions are folded together so that the sheet portions 3, 4 are held between the sheet portions 1 and 2 and so that respective back surface sides 1*b* and 2*b* of the sheet portions 1 and 2 which respectively have information writing sections 10*a* and 10*a* are positioned inside, and then the edge projections 12, 12, 12 of the sheet portion 1 are folded to cover the corresponding three peripheral edge portions of the front surface side 2*f* of the sheet portion 2 for adhesive bonding in same manner as in Embodiment No. 8.

The receiver of the letter sheet from the sender fills up the information writing sections 10*b*, 10*b* on the front surface sides 3*f* and 4*f* of the sheet portions 3 and 4 by writing the required information therein, and then separates the sheet portions 1, 2 from the other sheet portions. Thereafter, as (e) and (f) of FIG. 9 show, the remaining sheet body is folded double and adhesive-bonded to form a letter for return.

In this embodiment, one surface each of two sheet portions, that is, two surfaces are used for information writing and, therefore, the space for supply of information from the sender to the receiver is increased by one surface space as compared with such space available in Embodiment No. 8. This enables the sender to amplify his questionnaire in both quality and quantity.

Other Embodiments

In the foregoing embodiments, one sheet body 5 is folded into individual sheet portions along a folding line or lines and adhesive-bonded. However, inasmuch as individual sheet portions can be adhesive-bonded without involving the possibility of exposure to the outside of the information requiring secrecy which is written on the relevant space of individual sheet portions, the sheet portions may be in separated condition. In that sense, whether or not the individual sheet portions are continuously formed into one sheet body 5 is not important.

In the above embodiments, the sheet portions are of same size; but it is understood that the sheet portions need not be of same size, provided that individual sheet portions can be adhesive-bonded without involving the possibility of exposure of the information written on any relevant sheet surface which requires secrecy.

The number of sheet portions, the number of information writing sections 10, the number of advertisement sections 9, and arrangement thereof are not limited to those shown in the foregoing embodiments. Needless to say, the number and arrangement of those members may be changed or altered as required, provided that there must be two sheet portions.

In the foregoing embodiments, adhesive 7 is provided in dotted fashion along two to three peripheral edge portions of specified sheet portion or portions and also on specified edge projections. It is understood, however, that locations for and manner of providing adhesive means are not limited to those shown in the above embodiments, provided that adhesive-bonding of specified sheet portions can be satisfactorily effected .

In the foregoing embodiment Nos. 3, 4, 6, 8, and 9, no particular mention is made as to the manner in which one or two sheet portions are separated at the time of return mailing. In order to facilitate such separation, however, it is of course possible to provide perforations at a predetermined site of the sheet body 5.

The foregoing embodiments relates to two-way post cards and two-way letter sheets for purposes of advertisement, questionnaire, information supply from the sender to the receiver, but it is understood that the scope of application of the two-way communication sheet according to the invention is not limited to that referred to in the embodiments; not only is the invention applicable for business purposes, but also it is applicable for use in other areas, such as greetings and answers thereto, offer of exercises in a correspondence course of education and response thereto, and so on. In the embodiments, the information writing sections 10 in particular are used for writing questionnaire and answer thereto (Embodiment No. 1), an invitation for purchase and details of a purchase order (Embodiment No. 2), and pieces of information exchanged between the sender and the receiver (Embodiment Nos. 3 to 9). Needless to say, however, such information writing section may be used in various different ways as required according to the purposes for which the communication sheet is used.

What is claimed is:

1. A two-way communication sheet in the form of a folded post card or letter sheet for forward and reply communication, comprising a sheet body consisting of at least first and second sheet portions, a forward addressing section for name and address of an addressee and a reply addressing section for name and address of reply or which are respectively provided on front and back surfaces of said at least first and second sheet portions, forward and reply information writing sections for writing written information which are respectively provided on at least one of the surfaces of first and second sheet portions other than that on which said forward addressing section and reply addressing section are provided, the front and back surfaces of the first and second sheet portion having adhesion means for adhering the front and back surfaces of the first and second sheet portions together such that the forward and reply information writing sections are respectively concealed.

2. A two-way communication sheet in the form of a folded post card or letter sheet as set forth in claim 1, wherein said information writing section is provided with see-through preventive means for preventing the written information given therein from being seen through externally of said sheet body.

3. A two-way communication sheet in the form of folded post card, or letter sheet, as set forth in claim 2, wherein said see-through preventive means is in the form of an aluminum deposited film interposed between two sheets of paper thereby to form the sheet body.

4. A two-way communication sheet in the form of a folded post card or letter sheet, as set forth in claim 1, wherein means for adhesion of the sheet portion having said information writing section to the other sheet portion is an adhesive.

* * * * *